US005865633A

United States Patent [19]

Hou

[11] Patent Number: 5,865,633

[45] Date of Patent: Feb. 2, 1999

[54] SAFETY SOCKET

[76] Inventor: Jr Chong Hou, P.O. Box 63-99, Taichung, Taiwan

[21] Appl. No.: 863,982

[22] Filed: May 27, 1997

[51] Int. Cl.[6] ..... H01R 13/44

[52] U.S. Cl. ..... 439/139; 439/143

[58] Field of Search ..... 439/139, 143, 439/135

[56] References Cited

U.S. PATENT DOCUMENTS 2,455,582 12/1948 Hoessel ..... 439/139

3,959,790 5/1976 Schuyler ..... 439/135

*Primary Examiner*—Neil Abrams

*Assistant Examiner*—Antoine Ngandjui

[57] ABSTRACT

A safety socket includes one or more pairs of terminals for engaging with a plug and a cover for covering the terminals. The cover has one or more pairs of apertures aligned with the terminals for allowing the plug to engage with the terminals. One or more knobs are rotatably secured to the cover and each has a pair of orifices for aligning with the apertures of the cover. A spring may rotate the knob relative to the cover and for disengaging the orifices from the apertures and for preventing the plug to engage through the orifices and the apertures inadvertently.

1 Claim, 3 Drawing Sheets

SAFETY SOCKET

BACKGROUND OF THE INVENTION

1. Field of the Invention

The present invention relates to a socket, and more particularly to a safety socket.

2. Description of the Prior Art

Typical sockets comprise a pair of holes for engaging with the two prongs of the plugs. Various kinds of safety devices have been developed for preventing the plug from engaging with the socket inadvertently. However, the safety mechanisms comprise a complicated configuration which is adverse for manufacturing and assembling and marketing purposes.

The present invention has arisen to mitigate and/or obviate the afore-described disadvantages of the conventional sockets.

SUMMARY OF THE INVENTION

The primary objective of the present invention is to provide a safety socket which includes a simplified configuration for decreasing the manufacturing cost and for simplifying the manufacturing and the assembling operations of the safety socket.

In accordance with one aspect of the invention, there is provided a safety socket comprising a body including at least one pair of terminals for engaging with a plug, a cover secured to the body and including at least one pair of apertures aligned with the terminals for allowing the plug to engage with the terminals, at least one knob rotatably secured to the cover, the at least one knob including a pair of orifices for aligning with the apertures of the cover, and means for rotating the at least one knob relative to the cover and for disengaging the orifices of the knob from the apertures of the cover and for preventing the plug to engage through the orifices and the apertures inadvertently.

The cover includes at least one depression for rotatably receiving the knob and includes at least one curved groove, the at least one knob includes a projection slidably engaged in the curved groove for limiting a rotational movement of the at least one knob relative to the cover. The cover includes a pin, the knob includes a notch, the rotating means includes a coil spring having a first end secured to the pin of the cover and having a second end secured to the notch of the knob. The knob includes an annular slot for receiving the coil spring.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
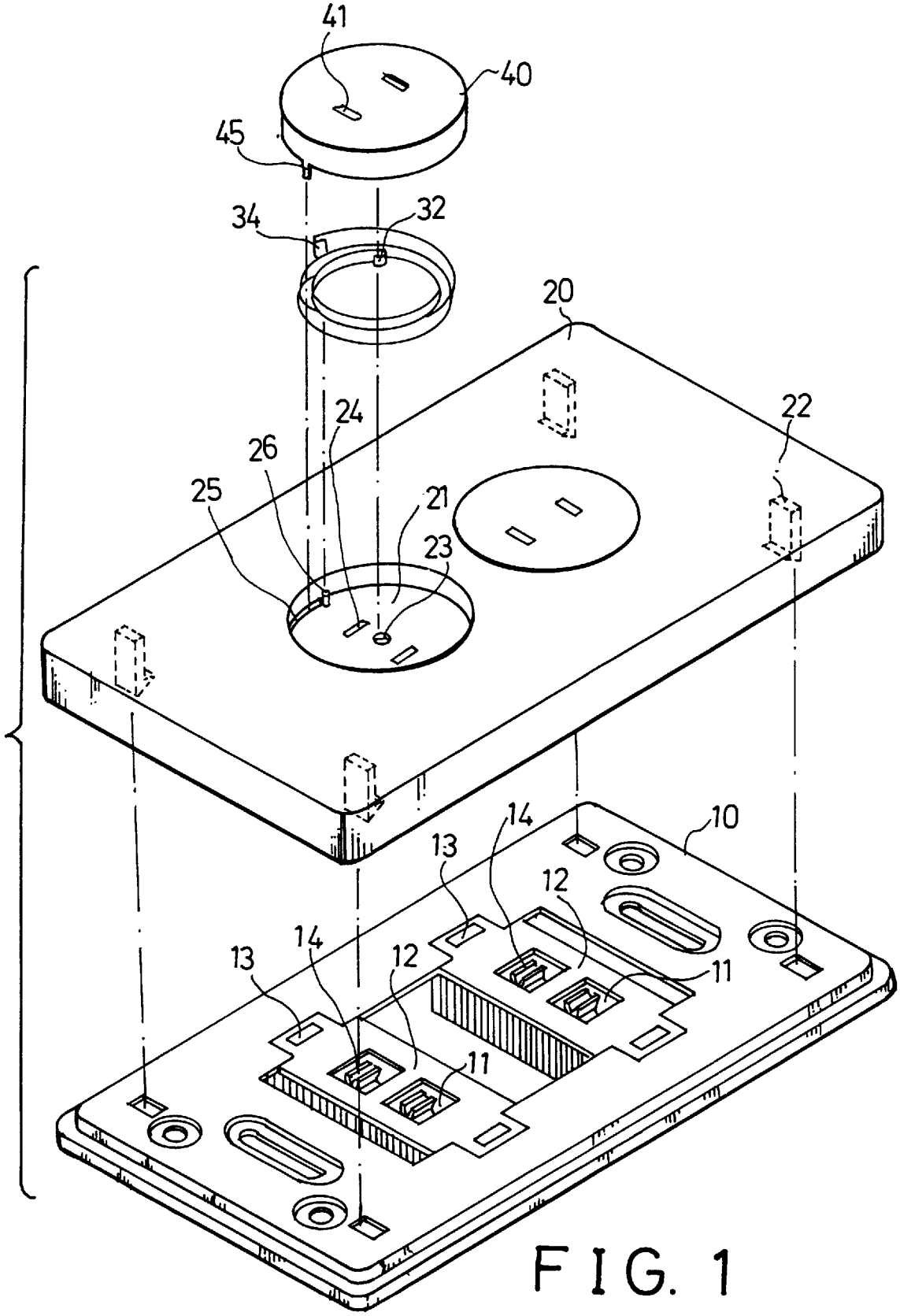
FIG. 1 is an exploded view of a safety socket in accordance with the present invention.
Figure 2:
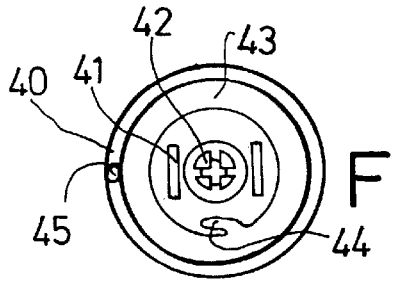
FIG. 2 is a bottom view of a knob.
Figure 3:
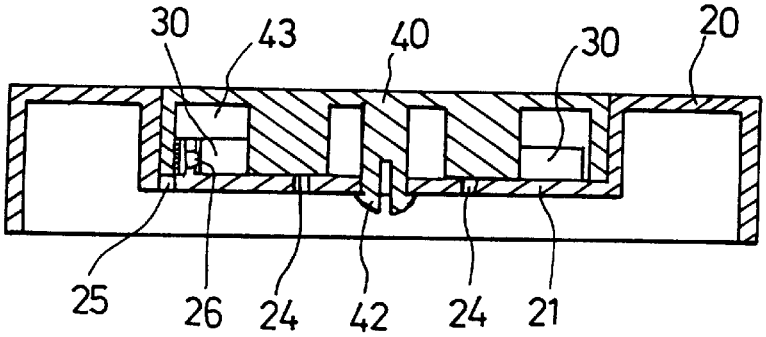
FIG. 3 is a cross sectional view taken along lines 3—3 of FIG. 4.
Figure 4:
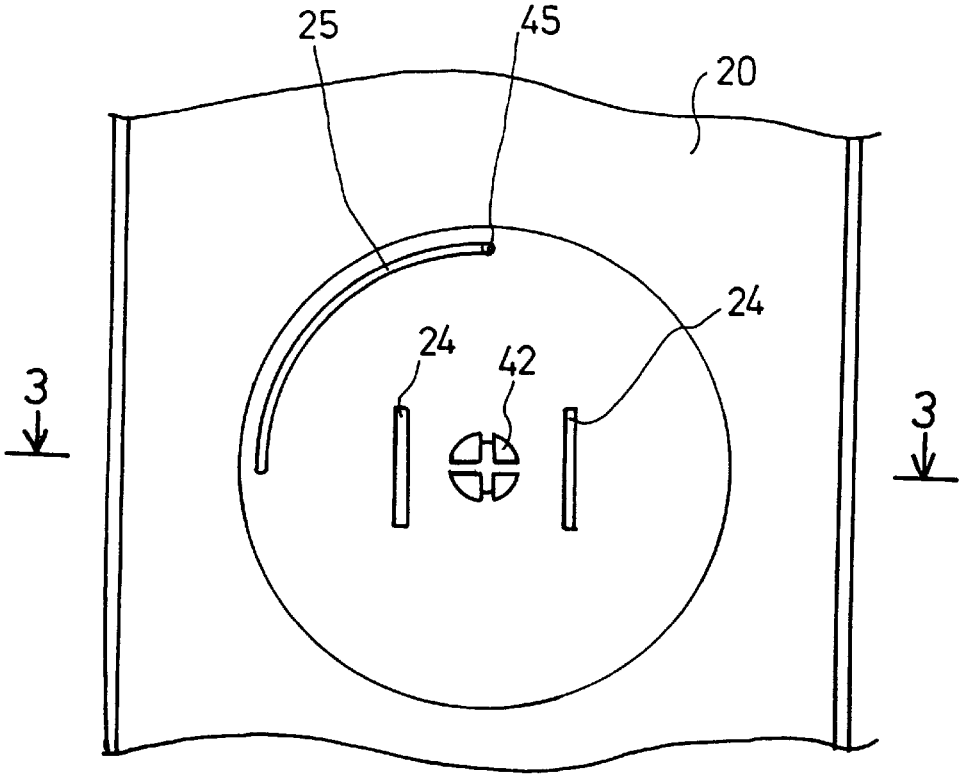
FIG. 4 is a partial bottom view of the cover.

Referring to the drawings, and initially to FIGS. 1–3, a safety socket in accordance with the present invention comprises a body 10 including at least one pair of terminals 14 for engaging with the prongs of the typical plug and including at least one panel 12 having two ends secured to the body 10 and having two openings 11 for exposing the terminals 14. A cover 20 includes four hooks 22 for securing to the body 10 and includes two apertures 24 aligned with the terminals 14 and includes a center hole 23. The cover 20 includes a depression 21 for rotatably receiving a knob 40. A curved groove 25 is formed in the cover 20 and formed in the peripheral portion of the depression 21. A pin 26 is provided in the depression 21.

Figure 5:
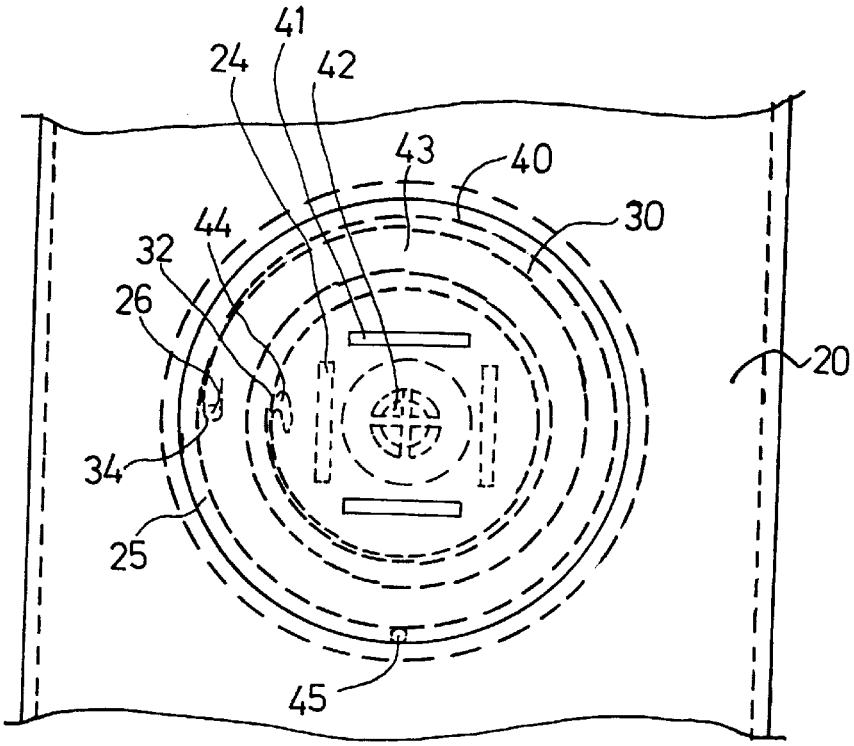
FIGS. 5 and 6 are top views of the socket for illustrating the operation of the socket.

The knob 40 includes s shaft 42 rotatably engaged in the center hole 23 of the cover 20 for allowing the knob 40 to be rotatably secured to the cover 20 and rotatably engaged in the depression 21. The knob 40 includes two orifices 41 for aligning with the apertures 24 of the cover 20 and the terminals 14 and includes a projection 45 slidably engaged in the curved groove 25 for limiting a rotational movement of the knob 40 relative to the cover 20 (FIG. 3). The knob 40 includes an annular slot 43 (FIGS. 2, 3) for receiving a coil spring 30 which has one end 34 secured to the pin 26 and which has the other end 32 secured to a notch 44 of the knob 40 (FIGS. 2, 5), for allowing the spring 30 to rotate the knob 40 relative to the cover 20 and for disengaging the orifices 41 of the knob 40 from the apertures 24 of the cover 20.

Figure 6:
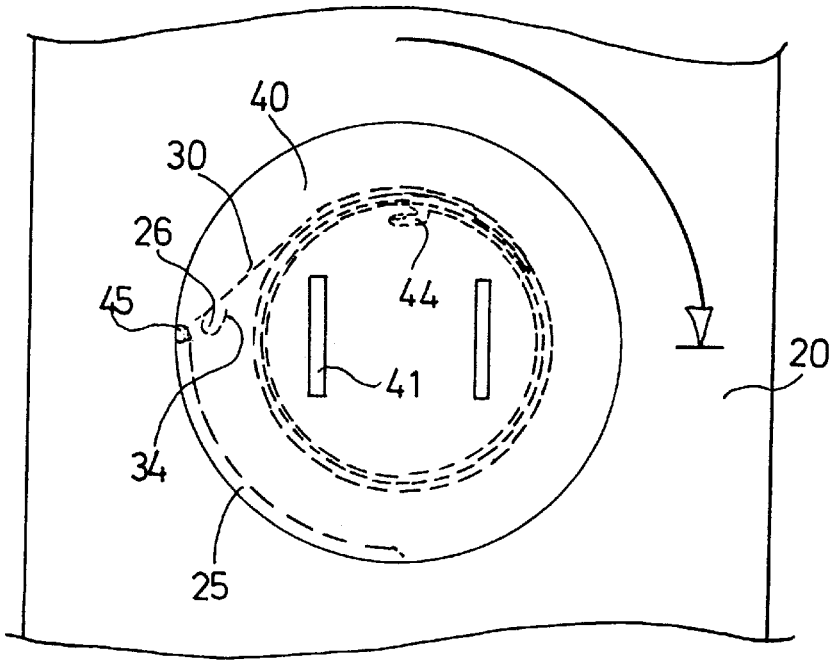

In operation, the prongs of the plug may be engaged into the apertures 24 of the cover 20 and engaged with the terminals 14 when the knob 40 is rotated by the plug (FIG. 5) until the orifices 41 are aligned with the apertures 24 of the cover 20 (FIG. 6).

Accordingly, the safety socket includes a knob 40 rotatably engaged in the cover for covering the terminals of the body and for allowing the plug to be engaged with the terminals when the knob is rotated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A safety socket for engaging with a plug, said safety socket comprising:

a body including at least one pair of terminals for engaging with the plug, a cover secured to said body and including at least one pair of apertures aligned with said terminals for allowing the plug to engage with said terminals, said cover including at least one depression formed therein and communicating with said at least one pair of apertures, said cover including at least one curved groove, said cover including a center portion, at least one knob rotatably secured to said cover and rotatably received in said at least one depression of said cover, said at least one knob including a pair of orifices for aligning with said apertures of said cover and including a projection slidably engaged in said at least one curved groove of said cover for limiting a rotational movement of said at least one knob relative to said cover, said at least one knob including an annular slot formed therein, said at least one knob including a shaft rotatably engaged in said center portion of said cover for allowing said knob to be rotatably secured to said cover and to be rotatably received in said at least one depression of said cover, and means for rotating said at least one knob relative to said cover and for disengaging said orifices of said at least one knob from said apertures of said cover and for preventing the plug to engage through said orifices and said apertures inadvertently, said rotating means including a coil spring having a first end secured to said cover and having a second end secured to said at least one knob, and said coil spring being received in said at least one annular slot of said at least one knob.

* * * * *